US006065977A

United States Patent [19]

Toda et al.

[11] Patent Number: 6,065,977

[45] Date of Patent: May 23, 2000

[54] DEVICE FOR CONNECTING CIRCUIT BOARDS TO EACH OTHER

[75] Inventors: Shinsaku Toda; Hiromitsu Kodama, both of Kanagawa, Japan

[73] Assignee: The Whitaker Corporation, Wilmington, Del.

[21] Appl. No.: 09/130,931

[22] Filed: Aug. 7, 1998

[30] Foreign Application Priority Data

Aug. 8, 1997 [JP] Japan ..... 9-227250

[51] Int. Cl.[7] ..... H01R 9/09

[52] U.S. Cl. ..... 439/66; 439/108; 361/799

[58] Field of Search ..... 439/66, 74, 108, 439/97; 361/790, 799

[56] References Cited

U.S. PATENT DOCUMENTS

| | | | |
|---|---|---|---|
| 4,643,509 | 2/1987 | Hollyday et al. | 439/607 |
| 4,813,128 | 3/1989 | Massopust | 29/830 |
| 4,875,140 | 10/1989 | Delpech et al. | 361/412 |
| 5,281,149 | 1/1994 | Petri | 439/66 |
| 5,355,282 | 10/1994 | Yokemura et al. | 361/760 |
| 5,380,211 | 1/1995 | Kawaguchi et al. | 439/74 |
| 5,536,177 | 7/1996 | Casey | 439/74 |
| 5,567,167 | 10/1996 | Hayashi | 439/75 |
| 5,685,073 | 11/1997 | Estes et al. | 29/883 |
| 5,755,592 | 5/1998 | Hillbish et al. | 439/541.5 |

FOREIGN PATENT DOCUMENTS

| | | | |
|---|---|---|---|
| 7-15107 | 6/1993 | Japan | H05K 1/14 |
| 1053027 | 12/1966 | United Kingdom | H05K 1/06 |

OTHER PUBLICATIONS

International Search Report from corresponding Great Britain application, 1 page, Feb. 3, 1999.

*Primary Examiner*—Renee S. Luebke
*Assistant Examiner*—T. C. Patel

[57] ABSTRACT

The present invention provides, at a low-manufacturing cost, a connector for connecting circuit boards to each other in which the area used exclusively for fastening the circuit boards is small, the work required in order to connect the circuit boards to each other in an electrically-continuous state is simple, and the connector has a simple structure. The connector for connecting circuit boards to each other comprises an insulating housing (11) which has a spacer member (12) that is disposed between upper and lower circuit boards (40,41), a conductive member (20) with a substantially C-shaped cross section is attached in a positional relationship such that the conductive member clamps onto the spacer member from above and below and establishes electrical continuity between conductive ground pads of the upper and lower circuit boards in a state in which the conductive member (20) is inserted between the upper and lower circuit boards (40,41), and a fastening means (30) fastens the upper and lower circuit boards to each other.

14 Claims, 3 Drawing Sheets

DEVICE FOR CONNECTING CIRCUIT BOARDS TO EACH OTHER

FIELD OF THE INVENTION

The present invention relates to a device or connector which connects circuit boards to each other.

BACKGROUND OF THE INVENTION

Conventionally, the device shown in FIGS. 6 and 7 is known as a device or connector for connecting circuit boards to each other, which is used in order to connect a plurality of circuit boards to each other as disclosed in Japanese Patent Application No. 7-15107.

In FIGS. 6A and 6B, the device or connector 100 for connecting circuit boards to each other has a fastening shaft 101 used to fasten two circuit boards 109,110; a spacer member 104 is engaged around the fastening shaft 101 and maintains a gap between the two circuit boards 109,110; and an attachment screw 105 used to fasten both circuit boards 109,110 on shaft 101.

The fastening shaft 101 is a plastic body including a large-diameter section and a small-diameter section with a shoulder 102 at an intersection therebetween. The surface of the plastic body is nickel plated or coated with a conductive paint. A threaded fitting 103 with which the attachment screw 105 is engaged, is formed by insert molding in an upper portion of the small-diameter section of the fastening shaft 101. The spacer member 104 is a ring-shaped member of a plastic or metal material, and the circumference thereof is nickel plated.

Furthermore, an insertion hole 111, which is used for the insertion of the small-diameter section of the fastening shaft 110, is located in lower circuit board 109, and ground pads 113 are located on both an upper surface and a bottom surface of circuit board 109 around the periphery of insertion hole 111. A fastening hole 112 is located in the upper circuit board 110 into which the attachment screw 105 is inserted and the diameter of which is smaller than that of the fastening hole 112, and ground pads 114 are located on both an upper surface and lower surface of circuit board 110 around the periphery of fastening hole 112.

FIG. 7A to 7D illustrate the method by which circuit boards 109,110 are connected to each other using the device or connector 100, as shown in FIG. 6.

In order to connect the upper and lower circuit boards 110,109 to each other in an electrically-continuous state, the small-diameter section of the fastening shaft 101 is first inserted into the insertion hole 111 of the lower circuit board 109 so that the lower circuit board is carried on the shoulder 102 of the fastening shaft 101 as shown in FIG. 7A. Next, as shown in FIG. 7B, spacer member 104 is placed onto and press-fitted on the small-diameter section of fastening shaft 101, so that the lower circuit board 109 is clamped between the spacer member 104 and the shoulder 102 of the fastening shaft 101.

Then, as shown in FIG. 7C, the upper circuit board 110 is placed on the surface formed by an upper surface of the fastening shaft 101 and an upper surface of the spacer member 104; and, as shown in FIG. 7D, attachment screw 105 is screwed into the threaded fitting 103 via the fastening hole 112. As a result, the upper circuit board 110 and lower circuit board 109 are fastened together.

When the upper circuit board 110 and lower circuit board 109 are fastened together, the ground pads 113 and 114 of the respective circuit boards 109,110 are placed in a state of electrical continuity with each other via the attachment screw 105, spacer member 104 and fastening shaft 101.

In conventional device or connector 100 for connecting circuit boards to each other, the area used exclusively for the fastening of the circuit boards 109,110 is small, so that electronic devices can be made more compact. However, such interconnection requires two operations—an operation in which the insertion hole 111 of the lower circuit board 109 is placed onto the small-diameter section of the fastening shaft 101, and an operation in which the spacer member 104 is placed onto and press-fitted on the small-diameter section of the fastening shaft 101. Accordingly, the work required in order to connect the circuit boards 109, 110 is time consuming.

Furthermore, the fastening shaft 101 used for connection must be formed from a plastic body including a large-diameter section and a small-diameter section, and it is also necessary to insert-mold the threaded fitting 103 in the upper portion of the small-diameter section, and to apply a nickel plating or a conductive paint to the surface of the fastening shaft 101. In addition, it is necessary to apply a nickel plating to the periphery of the spacer member 104. As a result, the structure of the device is complicated, and the cost of manufacture is high.

Accordingly, the object of the present invention is to provide, at a low manufacturing cost, a device or connector for connecting circuit boards to each other in which the area used exclusively for fastening the circuit boards is small, the work required in order to connect the circuit boards to each other in an electrically-continuous state is simple, and the connector has a simple structure.

SUMMARY OF THE INVENTION

The device or connector of the present invention for connecting circuit boards to each other comprises an insulating housing which has a spacer member that is disposed between upper and lower circuit boards; an integral conductive member with a substantially C-shaped cross section is attached in a positional relationship such that the conductive member clamps onto the spacer member of the insulating housing from above and below and establishes electrical continuity between conductive ground pads of the upper and lower circuit boards in a state in which the conductive member is inserted between the upper and lower circuit boards and upper and lower surfaces of the spacer member; a fastening means in the form of an attachment screw passes through the upper and lower circuit boards, the conductive member and the spacer member; and a nut is fastened to the attachment screw, thereby fastening the upper and lower circuit boards to each other. The device or connector of the present invention comprises a connector may further have a plurality of electrical contacts which are disposed in the insulating housing.

An embodiment of the present invention will now be described by way of example with reference to the accompanying drawings, in which:

BRIEF DESCRIPTION OF THE DRAWINGS

FIG. 6A is an exploded perspective view, and FIG. 6B is a cross-sectional view showing a state in which the circuit boards are connected to each other.

FIG. 7A is an isometric view showing a state in which a lower circuit board is placed on a shoulder of a fastening shaft, FIG. 7B is an isometric view showing a state in which the lower circuit board is clamped against the shoulder of the fastening shaft by a spacer member, FIG. 7C is an isometric view showing a state in which the upper circuit board is placed on an upper surface of the fastening shaft and an upper surface of the spacer member, and FIG. 7D is an isometric view showing a state in which the upper circuit board and lower circuit board are fastened together by means of an attachment screw.

DETAILED DESCRIPTION OF THE INVENTION

Figure 1:
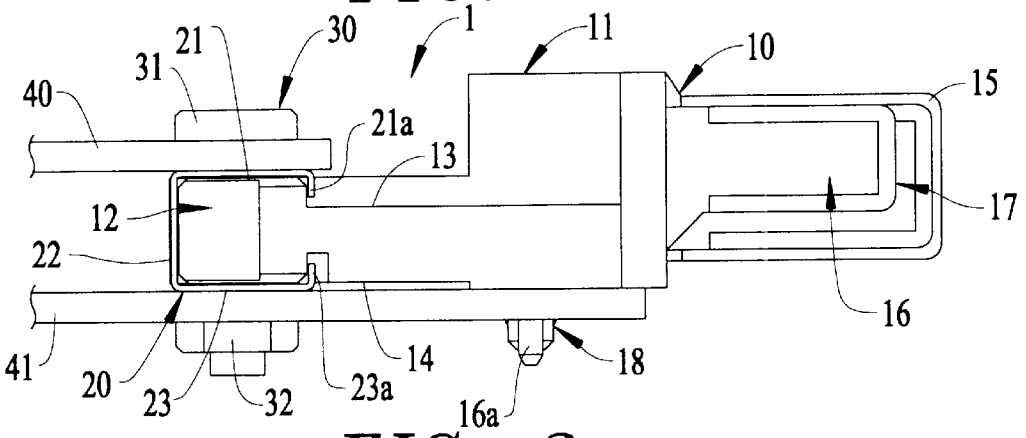
FIG. 1 is a front view illustrating a state in which circuit boards are connected to each other by means of a connector of the present invention connecting the circuit boards to each other.
Figure 2:
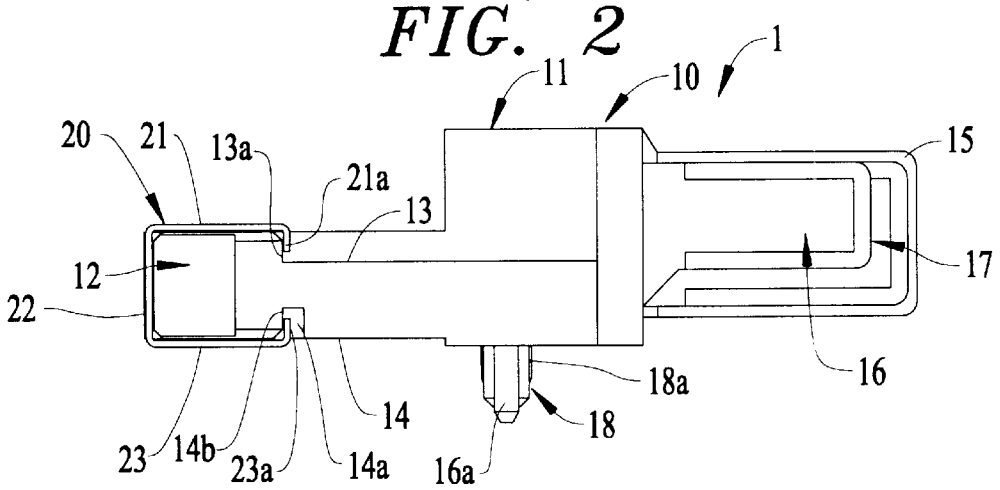
FIG. 2 is a front view of the connector shown in FIG. 1 without the circuit boards.
Figure 3:
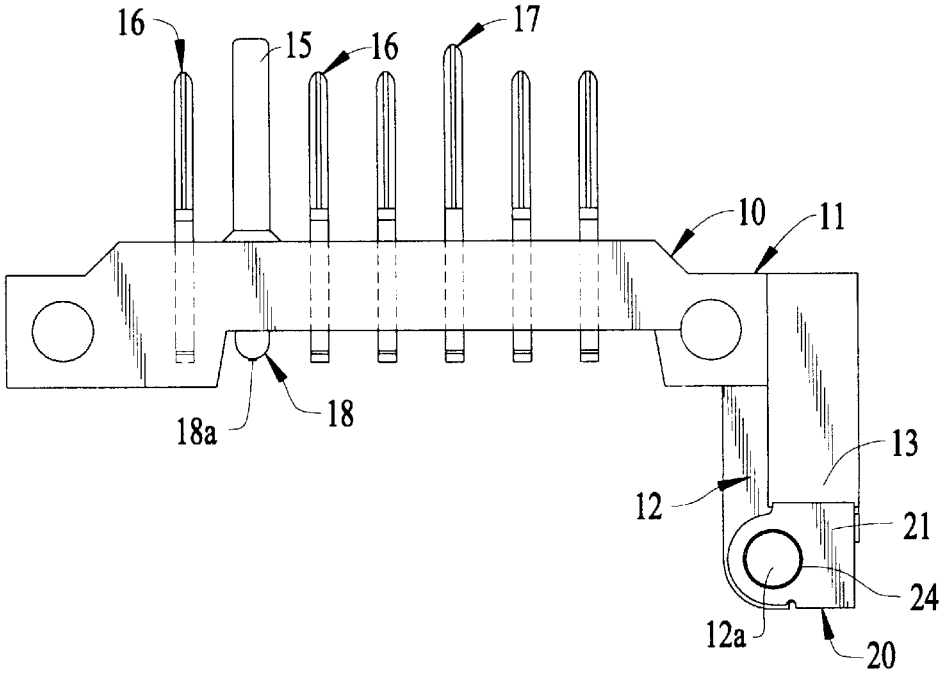
FIG. 3 is a top plan view of the connector shown in FIG. 2.

In FIG. 1, the device or connector 1 for connecting circuit boards to each other comprises an electrical connector 10 including an insulating housing 11 that is equipped with a spacer member 12 that is installed between an upper circuit board 40 and a lower circuit board 41, and that is fastened to a surface of the lower circuit board 41. Connector 1 further includes a conductive member 20 to establish electrical continuity between conductive ground pads (not shown) of the upper and lower circuit boards 40,41, and a fastening means 30, which fastens the upper and lower circuit boards 40,41 to each other.

As shown in FIGS. 2–5, the electrical connector 10 further comprises a plurality of signal contacts 16 and a ground contact 17 that are installed in a row in the insulating housing 11. A spacer member 12 is positioned between the upper circuit board 40 and lower circuit board 41 and is disposed on the right hand end of the insulating housing 11 (i.e., the right hand end in FIG. 3). A recessed section 13 is formed in a portion of an upper surface of the spacer member 12, and is recessed downward in order to allow the attachment of the conductive member 20. A recessed section 14 is formed in a bottom surface of the spacer member 12 and is recessed upward and a groove 14*a* is formed in the recessed section 14, in order to allow the attachment of the conductive member 20 to spacer member 12. Spacer member 12 includes a through-hole 12*a*, through which is passed an attachment screw 31 constituting the fastening means 30. In addition, a key member 15 is used to prevent erroneous engagement when the connector 10 is engaged with a mating connector (not shown), and protrudes from a front surface of the housing 11 (i.e., toward the right in FIG. 2) between signal contacts 16 located toward the left end of the insulating housing 11. A positioning post 18 protrudes downward along an opposite surface of the insulating housing 11 from the key member 15, and is used for positioning when the connector 10 is formed. Press-fitting projections 18*a* protrude from the positioning post 18 and are used for temporary fastening of the connector 10 when the tine sections 16*a*,17*a* of the signal contacts 16 and ground contact 17 are soldered to the lower circuit board 41.

The conductive member 20 is an integral member which is formed by stamping and bending a metal plate into a substantially C-shaped cross section, and has an upper plate 21, a connecting plate 22 and a lower plate 23. Bent members 21*a*,23 are located at front ends of the upper plate 21 and the lower plate 23, and they are bent so that the front members face each other. Holes 24 are formed in the upper plate 21 and lower plate 23, through which a bolt 31 constituting the fastening means 30 is passed. Conductive member 20 is attached in a positional relationship such that the member 20 clamps onto the spacer member 12 from above and below so that the bent member 21*a* on the upper plate 21 is positioned against a surface 13*a* of the recessed section 13 of the spacer member 12, and the bent member 23*a* on the lower plate 23 is positioned in the groove 14*a* in the recessed section 14 of the spacer member 12. Conductive member 20 is attached to the spacer member 12 by being caused to slide from a right end of the spacer member 12 toward the left end thereof. In an arrangement in which the conductive member 20 attached to the spacer member 12 is inserted between the upper and lower circuit boards 40,41 and an upper surface and a lower surface of the spacer member 12, conductive member 20 establishes electrical continuity between the conductive ground pads (not shown) formed on the upper circuit board 40 and lower circuit board 41.

The fastening means 30 comprises attachment screw 31 and a nut 32 which is thereby threadably fastened to the attachment screw 31. From above the upper circuit board 40, the attachment screw 31 is passed through an aperture (not shown) in the circuit board 40, the hole 24 in the upper plate 21 of the conductive member 20, the through-hole 12*a* in the spacer member 12, the hole 24 in the lower plate 23 of the conductive member 20, and an aperture (not shown) in the lower circuit board 41. Nut 32 is threadably tightened onto the attachment screw 31 from beneath the lower circuit board 41, so that both circuit boards 40 and 41 are now fastened to each other.

Next, with reference to FIG. 1, the method will now be described to connect the upper circuit board 40 and lower circuit board 41 to each other in an electrically-continuous state by means of the connector 1.

Figure 4:
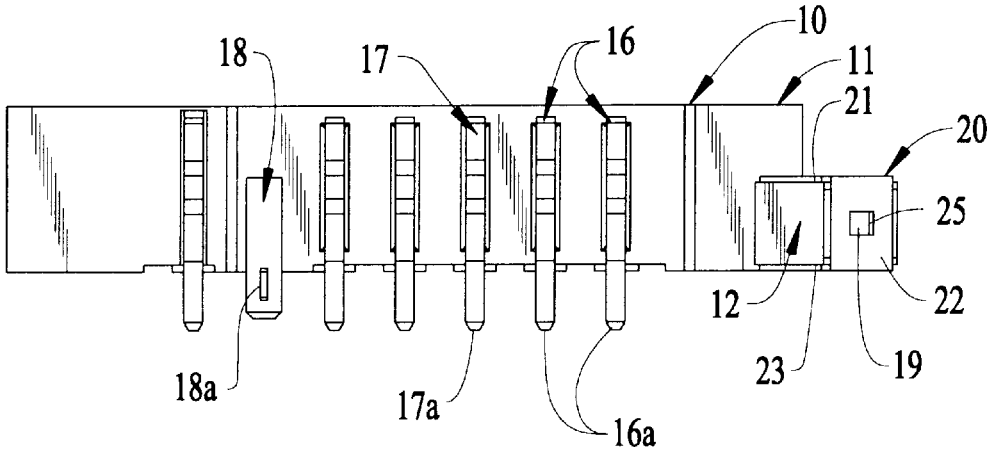
FIGS. 4 and 5 are rear and bottom views of the connector shown in FIGS. 2 and 3.
Figure 5:
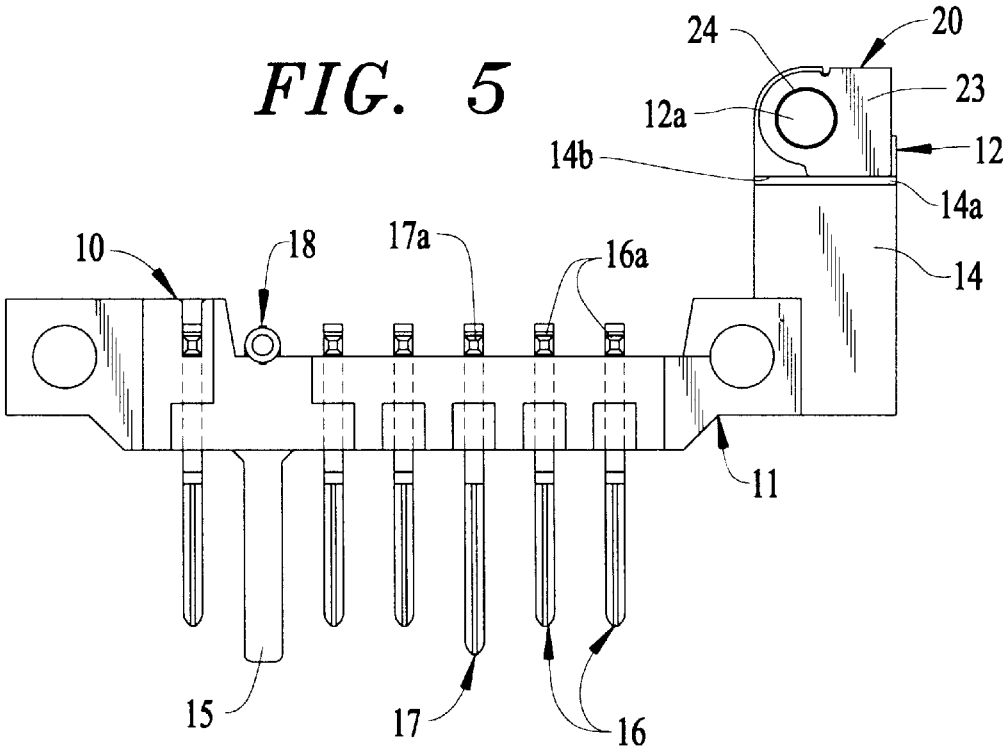
Figure 6A:
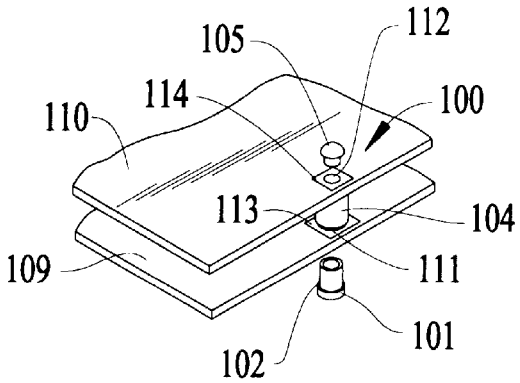
FIG. 6A PRIOR ART
FIGS. 6A and 6B show a conventional connector for connecting circuit boards to each other.
Figure 6B:
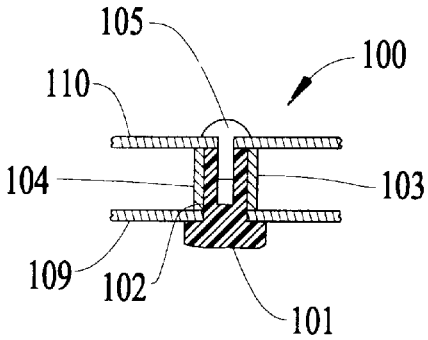
FIG. 6B PRIOR ART
Figure 7A:
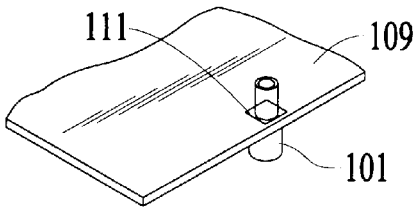
FIG. 7A PRIOR ART
FIGS. 7A–D illustrate the method used to connect the circuit boards to each other using the connector for connecting circuit boards to each other shown in FIG. 6.
Figure 7B:
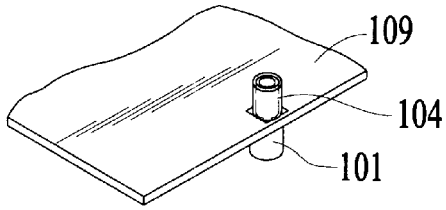
FIG. 7B PRIOR ART
Figure 7C:
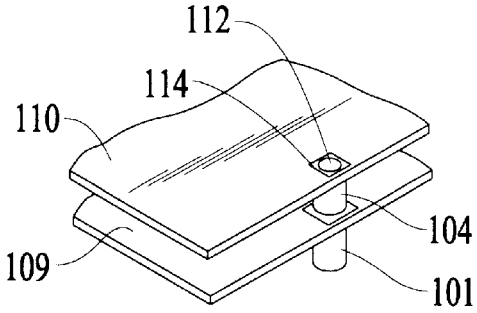
FIG. 7C PRIOR ART
Figure 7D:
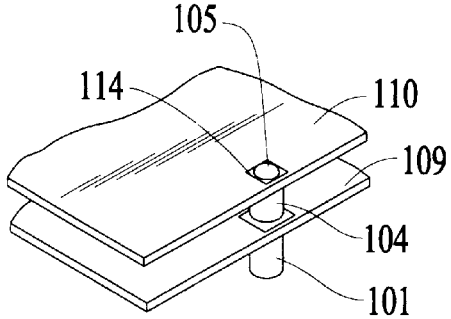
FIG. 7D PRIOR ART

First, the conductive member 20 is mounted onto the spacer member 12 of the connector 10 so that the conductive member 20 is attached to the insulating housing 11 in a positional relationship which is such that the conductive member 20 clamps onto the spacer member 12 from above and below. In this case, the bent member 21*a* on the upper plate 21 of the conductive member 20 engages with the surface 13*a* of the recessed section 13 in the upper surface of the spacer member 12; the bent member 23*a* on the lower plate 23 is disposed within the groove 14*a* against surface 14*b* in the recessed section 14 of the spacer member 12; and the connecting plate 22 engages with a rear end (i.e., the left end in FIG. 1) of the spacer member 12. Accordingly, the conductive member 20 is prevented from moving in the forward-backward direction relative to the connector 10. Furthermore, as shown in FIG. 4, an opening 25 formed in the connecting plate 22 of the conductive member 20 receives a projection 19 on the rear end of the spacer member 12, so that moving of the conductive member 20 in the left-right direction is prevented. In the arrangement in which the conductive member 20 is attached to the spacer member 12 of the connector 10, the lower plate 23 of the conductive member 20 is positioned inside the recessed section 14 formed in the lower surface of the spacer member 12, so that the lower surface of the lower plate 23 and the lower surface of the insulating housing 11 are in the same plane.

Next, the connector 10 with the conductive member 20 attached to the spacer member 12 is installed between the upper circuit board 40 and the lower circuit board 41. In order to accomplish this installation, the connector 10 is first fastened to the surface of the lower circuit board 41. In this fastening process, the tine sections 16*a* of the signal contacts 16 and the tine section 17*a* of the ground contact 17 of the connector 10 (the position of which is determined by the positioning post 18) are inserted into through-holes in the lower circuit board 41 and connected thereto by soldering. In this case, the respective signal contacts 16 and the ground contact 17 are connected to conductive signals pads (not shown) and a conductive ground pad (not shown) formed on the surface of the lower circuit board 41, and the lower plate 23 of the conductive member 20 engages a conductive ground pad (not shown) formed on the lower circuit board 41. Afterward, the upper circuit board 40 is placed on the upper plate 21 of the conductive member 20. As a result of this placement, a conductive ground pad (not shown) formed on the upper circuit board 40 engages the upper plate 21 of the conductive member 20, so that the conductive ground pads of the upper and lower circuit boards 40,41 are electrically connected to each other.

Finally, the upper and lower circuit boards 40,41 are fastened to each other by the fastening means 30. In order to accomplish such fastening, the attachment screw 31 is passed (from above the upper circuit board 40) through the aperture in the upper circuit board 40, the hole 24 in the upper plate 21 of the conductive member 20, the through-hole 12*a* of the spacer member 12, the hole 24 in the lower plate 23 of the conductive member 20 and the aperture in the lower circuit board 41; and nut 32 is threaded onto the attachment screw 31 from beneath the lower circuit board 41 until it tightly engages the lower circuit board.

Thus, in the present invention, in order to connect the upper circuit board 40 and lower circuit board 41 to each other in a state of electrical continuity, it is sufficient to perform an operation in which the conductive member 20 is attached in a positional relationship which is such that the conductive member 20 clamps the spacer member 12 of the connector 10 from above and below, the connector 10 with the conductive member 20 attached to the spacer member 12 is installed between the upper circuit board 40 and the lower circuit board 41, and the upper circuit board 40 and lower circuit board 41 are fastened to each other by the fastening means 30. Thus, the work required in order to connect the circuit boards 40,41 together is simple.

Furthermore, since the device or connector 1 for connecting circuit boards to each other is constructed from an insulating housing 11 which has a spacer member 12, an integral conductive member 20 which is substantially C-shaped in cross-section, and a fastening means 30 which comprises a common attachment screw 31 and nut 32, the structure of the connector is therefore simple, and the cost of manufacture is very low.

Moreover, since the fastening means is an attachment screw which is passed through the upper and lower circuit boards, the conductive member and the spacer member, and a nut which is threaded onto the attachment screw, the area used exclusively for the fastening of the circuit boards is small.

In the present invention, the operation used to connect the upper and lower circuit boards to each other is simple, the structure of the device is simple and the manufacturing cost is low; in addition, the device can be used as an electrical connector which is engaged and connected with a mating electrical connector.

What is claimed is:

1. A connector for connecting circuit boards together, comprising:

an insulating housing including a spacer member;

electrical contacts mounted on the insulating housing and including tine sections for electrical connection to one of the circuit boards and contact sections for matable connection with matable contact members of a matable connector;

a conductive member mounted on the spacer member and having an upper and a lower conductive member for engagement with conductive pads on an upper circuit board and a lower circuit board to establish electrical continuity therebetween; and fastening means extending through the circuit boards, the upper and lower conductive members and the spacer member thereby fastening the circuit boards on the upper and lower conductive members and electrically connecting the circuit boards to each other.

2. A connector for connecting circuit boards together as claimed in claim 1, wherein the spacer member extends outwardly from one end of the insulating housing.

3. A connector for connecting circuit boards together as claimed in claim 2, wherein the spacer member has surfaces against which bent members of said conductive members engage to clamp the conductive member onto the spacer member.

4. A conductor for connecting circuit boards together as claimed in claim 3, wherein the conductive member is C-shaped.

5. A connector for connecting circuit boards together as claimed in claim 1, wherein the fastening means comprises a screw and a nut.

6. A connector for connecting circuit boards together as claimed in claim 1, wherein a post member is provided by the insulating housing for engagement in a hole in one of the circuit boards.

7. A connector for connecting circuit boards together as claimed in claim 1, wherein a key member is provided by the insulating housing for preventing erroneous engagement with the matable connector.

8. An electrical connector for connecting circuit boards together and for matable connection with a matable electrical connector, comprising:

an insulating housing having a spacer member extending outwardly therefrom;

electrical contacts mounted on the insulating housing and having contact sections extending outwardly from a connector-mating surface of the insulating housing for electrical connection with matable electrical contact members of the matable electrical connector and board contact sections extending outwardly from a board-engaging surface of the insulating housing for electrical connection with one of the circuit boards;

a conductive member on the spacer member and including an upper and a lower conductive member for electrical connection with respective conductive pads on the circuit boards;

clamping members provided by the conductive member and the spacer member clamping the conductive member to the spacer member; and a fastening member extending through the circuit boards, the upper and lower conductive members and the spacer member thereby fastening the circuit boards on the spacer member with the upper and lower conductive members electrically connecting the circuit boards together.

9. An electrical connector as claimed in claim 8, wherein the spacer member extends outwardly from one end of the insulating housing.

10. An electrical connector as claimed in claim 8, wherein the clamping members include bent members of the upper and lower conductive members engaging surfaces of the spacer member.

11. An electrical connector as claimed in claim 8, wherein the fastening member comprises a screw and a nut.

12. An electrical connector for connecting circuit boards together, comprising:

an insulating housing including a spacer member extending outwardly from one end thereof;

a conductive member mounted on the spacer member and having an upper and a lower conductive member for engagement with conductive members on an upper circuit board and a lower circuit board to establish electrical continuity therebetween; and fastening means extending through the circuit boards, the upper and lower conductive members and the spacer member thereby fastening the circuit boards on the upper and lower conductive members and electrically connecting the circuit boards to each other.

13. An electrical connector as claimed in claim 12, wherein the spacer member extends rearwardly from the insulating housing and normal thereto.

14. An electrical connector as claimed in claim 12, wherein clamping members are provided by the conductive member and the spacer member clamping the conductive members to the spacer member.

* * * * *